US010386144B1

(12) United States Patent
Facteau et al.

(10) Patent No.: US 10,386,144 B1
(45) Date of Patent: Aug. 20, 2019

(54) FIRING MECHANISM ASSEMBLY

(71) Applicant: U.S. Government as Represented by the Secretary of the Army, Dover, NJ (US)

(72) Inventors: Robert J. Facteau, Troy, NY (US); George E. Hathaway, IV, Watervliet, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/126,185

(22) Filed: Sep. 10, 2018

(51) Int. Cl.

| | |
|---|---|
| ***F41A 19/00*** | (2006.01) |
| ***F41A 19/08*** | (2006.01) |
| ***F41A 17/64*** | (2006.01) |
| ***F41F 1/06*** | (2006.01) |

(52) U.S. Cl.
CPC ..... *F41A 19/08* (2013.01); *F41A 17/64* (2013.01); *F41F 1/06* (2013.01)

(58) Field of Classification Search
CPC ..... F41F 1/06
See application file for complete search history.

(56) References Cited

U.S. PATENT DOCUMENTS

| | | | | |
|---|---|---|---|---|
| 2,477,253 A * | 7/1949 | Jasse | F41A 19/29 | 89/1.3 |
| 2,503,309 A | 4/1950 | Weiss | | |
| 3,074,322 A * | 1/1963 | Jasse | F41A 19/40 | 89/27.11 |
| 3,782,240 A | 1/1974 | Feldmaier | | |
| 4,709,614 A * | 12/1987 | Klumpp | F41F 1/06 | 89/1.35 |
| 4,744,283 A * | 5/1988 | Ibarra | F41F 1/06 | 89/26 |
| 6,851,348 B1 * | 2/2005 | Ang | F41A 13/04 | 89/1.2 |

FOREIGN PATENT DOCUMENTS

| | | | | |
|---|---|---|---|---|
| GB | 146901 A * | 10/1921 | ..... | F41A 17/64 |

* cited by examiner

*Primary Examiner* — Gabriel J. Klein
(74) *Attorney, Agent, or Firm* — John P. DiScala

(57) ABSTRACT

An external firing mechanism for a muzzle loaded mortar system incorporates a drop fire mode, a lever fire mode and a safe mode. The firing mechanism is easy to assemble or replace and does not require an adjustment procedure when mounting to the mortar system. The firing mechanism utilizes bearing balls as a tripping device which transfers potential energy in a compressed spring to kinetic energy of a firing pin oriented orthogonal to that spring.

16 Claims, 12 Drawing Sheets

Section I-I

Section II-II

FIRING MECHANISM ASSEMBLY

STATEMENT OF GOVERNMENT INTEREST

The inventions described herein may be manufactured, used and licensed by or for the United States Government.

BACKGROUND OF THE INVENTION

The invention relates in general to weapon systems and in particular to firing mechanisms for weapon systems.

Mortars are indirect fire weapons which launch rounds in high arc ballistic trajectories to defeat enemy troops, materiel, bunkers and other infantry-type targets. Mortars typically comprise a cannon fixed to a base plate with a mounting structure. Mortars are muzzle loaded and rounds are fired by contact with a firing pin which may be fixed at the base of the mortar cannon or selectively put in contact by a firing mechanism.

Mortars can produce a significant amount of blast pressure during firing. This is especially true for large mortars such as 120 mm mortar systems. High blast pressures may have severe adverse effects on the operating crew including significant hearing damage and damage to other bodily organs. Accordingly, there is a desire for a mortar firing mechanism which allows for remote firing from a safe distance.

There are additional performance issues with conventional mortar firing mechanisms. Due to the design of some currently available firing mechanisms, stack-up tolerances on assembled components can cause low firing pin protrusion into the cannon. During firing and after normal wear and tear it can fall below the minimum firing pin protrusion in a short amount of time. A low protruding firing pin can cause misfires resulting in loss of effectiveness and possible injury or fatalities.

A need exists for an external firing mechanism for a mortar system which allows for remote operation, is easy to assemble and replace and ensures proper firing pin protrusion.

SUMMARY OF INVENTION

One aspect of the invention is a firing mechanism assembly for a mortar system. The firing mechanism assembly is capable of operating in a drop fire mode, a lever fire mode and a safe mode. The firing mechanism comprises a lever assembly, a sear assembly and a selector. The lever assembly comprises a lever for receiving a rotation input from a user. The sear assembly is engaged with the lever assembly for transferring the rotational motion of the lever assembly to a linear motion of a driver thereby causing a firing pin to protrude into a cannon. The sear assembly further comprises a plunger, a driver and a cage assembly. The plunger engages with the lever assembly and compresses a preloaded die spring in response to a rotation of the lever assembly. The driver is in communication with the preloaded die spring and is translated downward by the die spring after a threshold translation of the plunger thereby causing the firing pin to protrude into the cannon. The cage assembly holds the driver in place until the threshold translation of the plunger. The selector places the firing mechanism assembly in either the drop fire mode, the lever fire mode or the safe mode by selectively restricting movement of the lever.

In another aspect of the invention, the firing mechanism is also capable of operating in a drop fire mode, a lever fire mode and a safe mode and comprises a lever assembly, a sear assembly, cage assembly and a selector. The lever assembly further comprises a lever, a pivot shaft and a pivot arm. The lever receives a rotational input from a user. The pivot shaft is connected to the lever. A pivot arm is captured by the pivot shaft and has an engagement portion at a distal end. A sear assembly is engaged with the lever assembly for transferring rotational motion of the lever assembly into linear motion of a driver thereby causing a firing pin to protrude into a cannon. The sear assembly comprises a plunger, a die spring and a driver. The plunger has a first notch for engaging with the engagement portion of the pivot arm thereby translating downward in response to a rotation of the pivot arm. The die spring is preloaded and in communication with the plunger. A downward translation of the plunger further compresses the die spring. The driver is in communication with the die spring and restrained by a cage assembly until the plunger is translated a threshold distance. Once the driver is released, the compression spring causes it to translate downward and engage with the firing pin. Engagement with the angled head of the driver causes the firing pin to protrude into the cannon. The cage assembly further comprises a cage, a sleeve and a ball detent. The cage is concentric with and surrounding a portion of the driver having a hole defined by the cage and dimensioned for holding a bearing ball. The sleeve is concentric with and surrounding a portion of the cage and having a groove defined by an inner surface of the sleeve. The ball detent is for selectively restraining the driver and further comprises a bearing ball restrained in the cage and between the inner surface of the sleeve and the driver. The bearing ball holds the driver in place until the sleeve is translated downward by the downward translation of the plunger causing the bearing ball to engage the groove of the sleeve and disengage the driver. The selector places the firing mechanism assembly in either the drop fire mode, the lever fire mode or the safe mode by selectively restricting movement of the lever.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A firing mechanism assembly allows for remote firing of an indirect fire muzzle loaded weapon system, such as a mortar system. The firing mechanism allows the user to select among three operating modes: lever fire mode, drop fire mode and safe mode. Advantageously, when operating in lever mode, the firing mechanism enables remote firing of the weapon system. The firing mechanism utilizes bearing balls as a tripping device which transfers potential energy in a compressed spring to kinetic energy of a firing pin, oriented 90° to that spring. Remote firing of the weapon system allows a user to fire the mortar from a safe distance and mitigates negative effects associated with firing of a mortar, such as blast overpressure.

In drop fire mode, the firing pin is held forward by a die spring to guarantee full firing pin protrusion into the mortar cannon. This helps mitigate issues associated with low firing pins including misfires or increased maintenance.

The firing mechanism is a direct bolt-on assembly external to the mortar cannon. Advantageously, the firing mechanism is easy to assemble or replace and requires no adjustment procedure when mounting to the mortar. Additionally, the selector switch is clear and easily read by a user during operation thereby decreasing the potentially fatal risk of error.

While the firing mechanism is described throughout as being employed on a 120 mm mortar system, the firing mechanism is not limited to use on a 120 mm mortar system and may be employed on a mortar system of a different size, such as a 60 mm or 81 mm mortar system. Further, the firing mechanism is not limited to only mortar weapon systems and may be utilized on any system which requires a firing mechanism and allows for operation in a lever mode and a drop fire mode.

Figure 1:
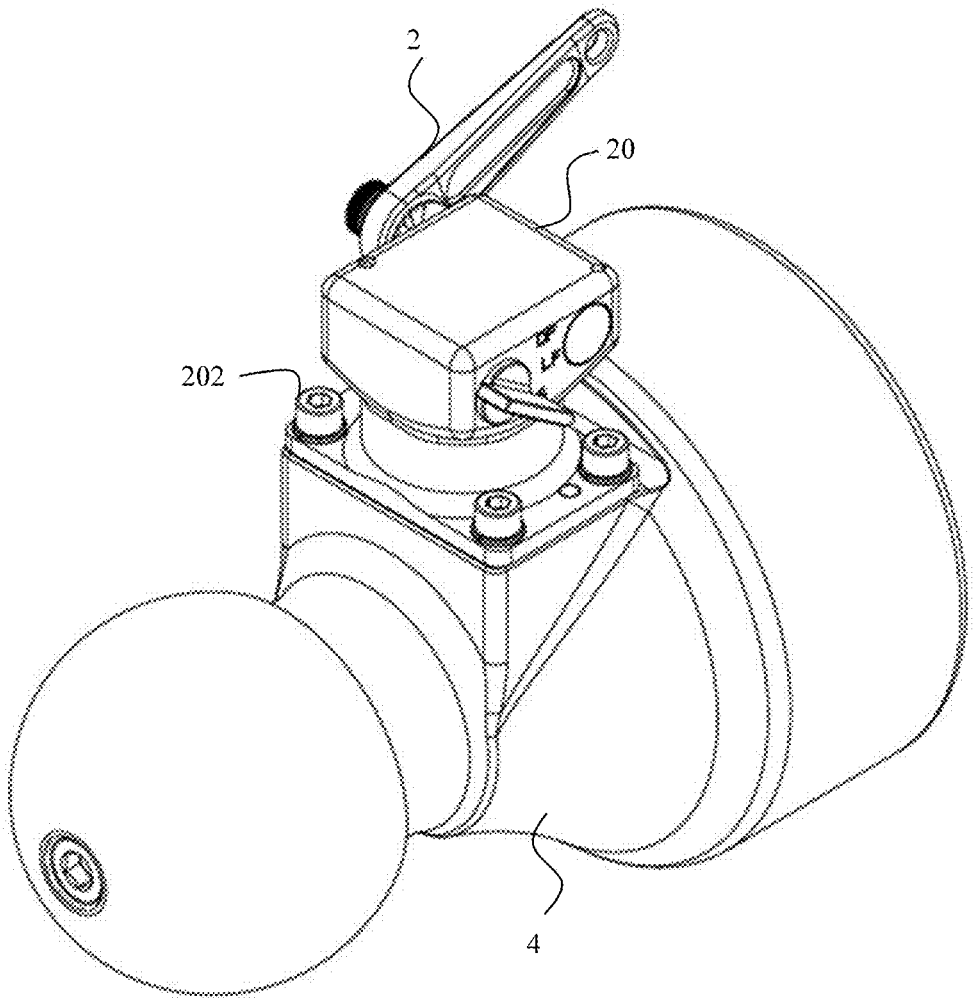
FIG. 1 is a perspective view of a firing mechanism mounted to the base cap of a mortar cannon, in accordance with an illustrative embodiment.

FIG. 1 is a perspective view of a firing mechanism mounted to the base of a mortar cannon, in accordance with an illustrative embodiment. The firing mechanism 2 is an assembly mounted to an external surface of the base cap 4 of a mortar cannon. The minor sub-assemblies and small components are housed in a compact case 20 that can be easily mounted or removed with four (4) screws 202. The firing mechanism 2 provides convenient access for assembly and removal.

Figure 2:
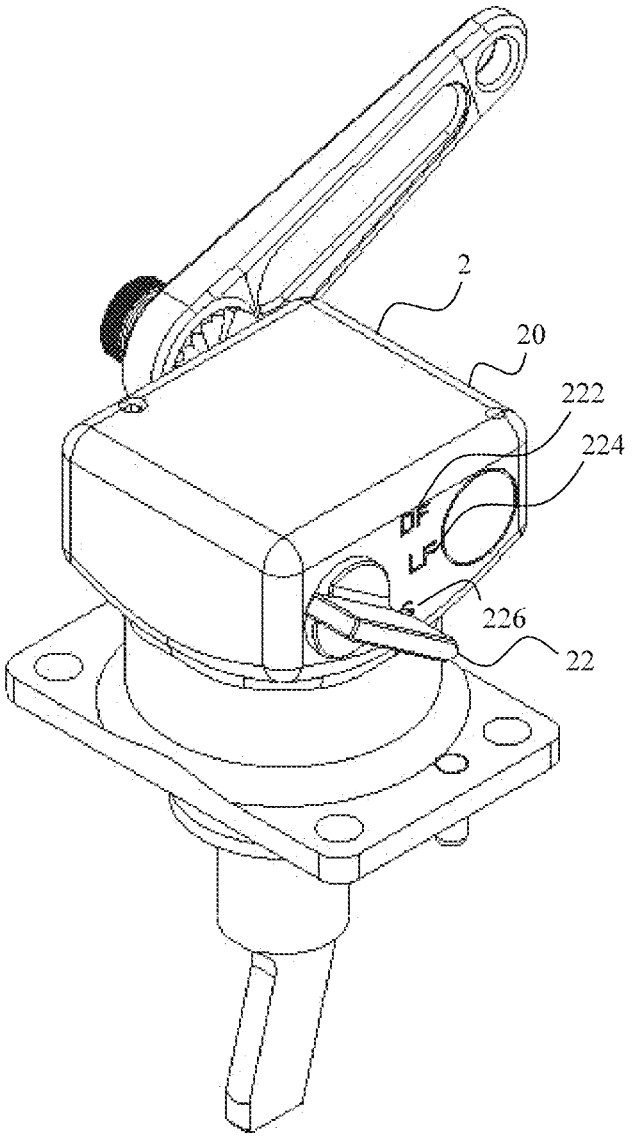
FIG. 2 is a top perspective view of the firing mechanism, in accordance with an illustrative embodiment of the invention.
Figure 3:
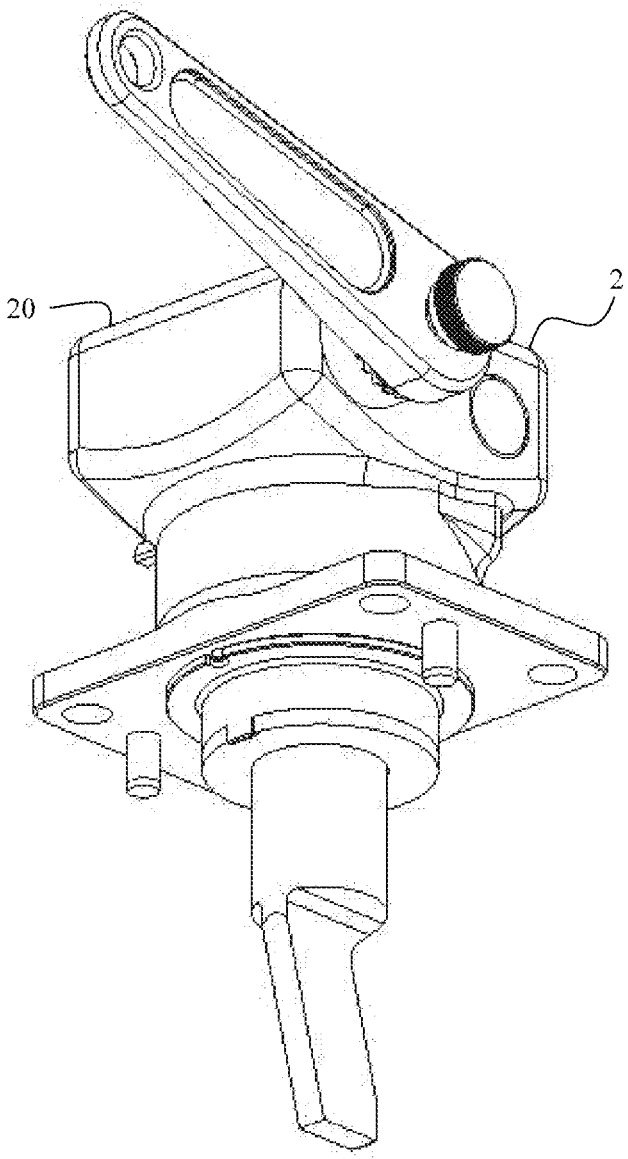
FIG. 3 is a bottom perspective view of the firing mechanism, in accordance with an illustrative embodiment of the invention.

FIG. 2 is a top perspective view of the firing mechanism, in accordance with an illustrative embodiment. FIG. 3 is a bottom perspective view of the firing mechanism, in accordance with an illustrative embodiment. The firing mechanism 2 has three operating modes—drop fire (DF) mode, lever fire (LF) mode and safe (S) mode. A user selects among the modes via a selector 22 protruding through the case 20. The selector 22 is rotated to one of three positions 222, 224, 226, each corresponding to an operating mode, with a legend indicating which mode is being selected. As will be shown in further detail below, the selector 22 is held in place by a compression spring and ball pressing against one of three detent grooves in the selector 22.

Figure 4:
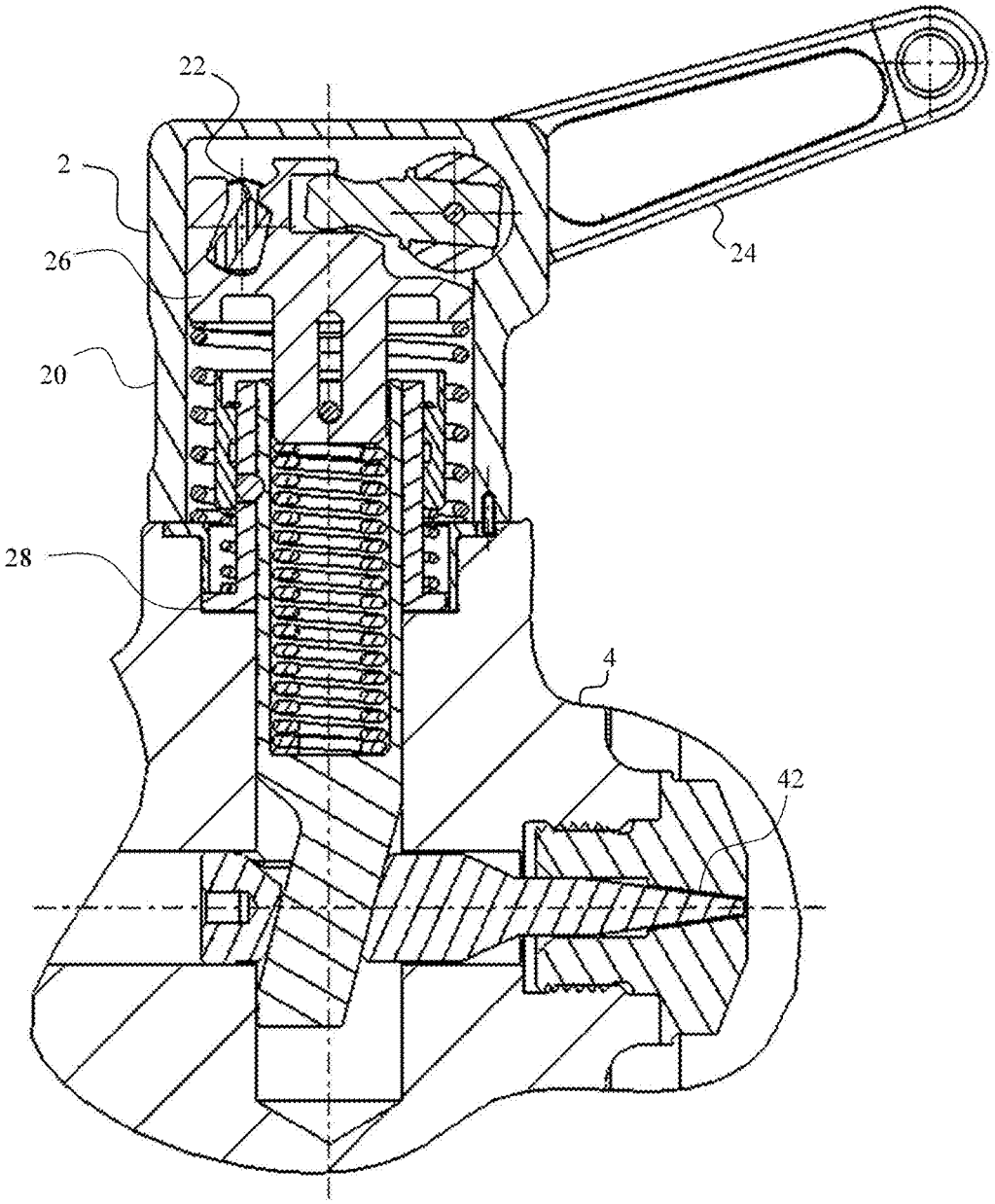
FIG. 4 is a side cross-sectional view of the firing mechanism and base cap of the mortar cannon, in accordance with an illustrative embodiment.

FIG. 4 is a side cross-sectional view of the firing mechanism and base cap of the mortar cannon, in accordance with an illustrative embodiment. The case 20 is mounted to the base cap 4 of the cannon. The firing mechanism 2 further comprises a lever assembly 24, a sear assembly 26, a cage assembly 28 and the selector 22. The firing mechanism 2 converts rotation of a lever assembly 24 into linear translation of a sear assembly 26. The sear assembly 26 in turn extends a firing pin 42 oriented 90 degrees from the sear assembly 26 forward into the breech of the cannon. The cage assembly 28 ensures that the firing pin 42 is extended with sufficient force to initiate a round by restraining the driver until sufficient potential energy has accumulated in the sear assembly 26. The selector 22 places the firing mechanism 2 into one of the three modes by restricting the movement of the sear assembly 26 and thereby the lever assembly 24.

Figure 5:
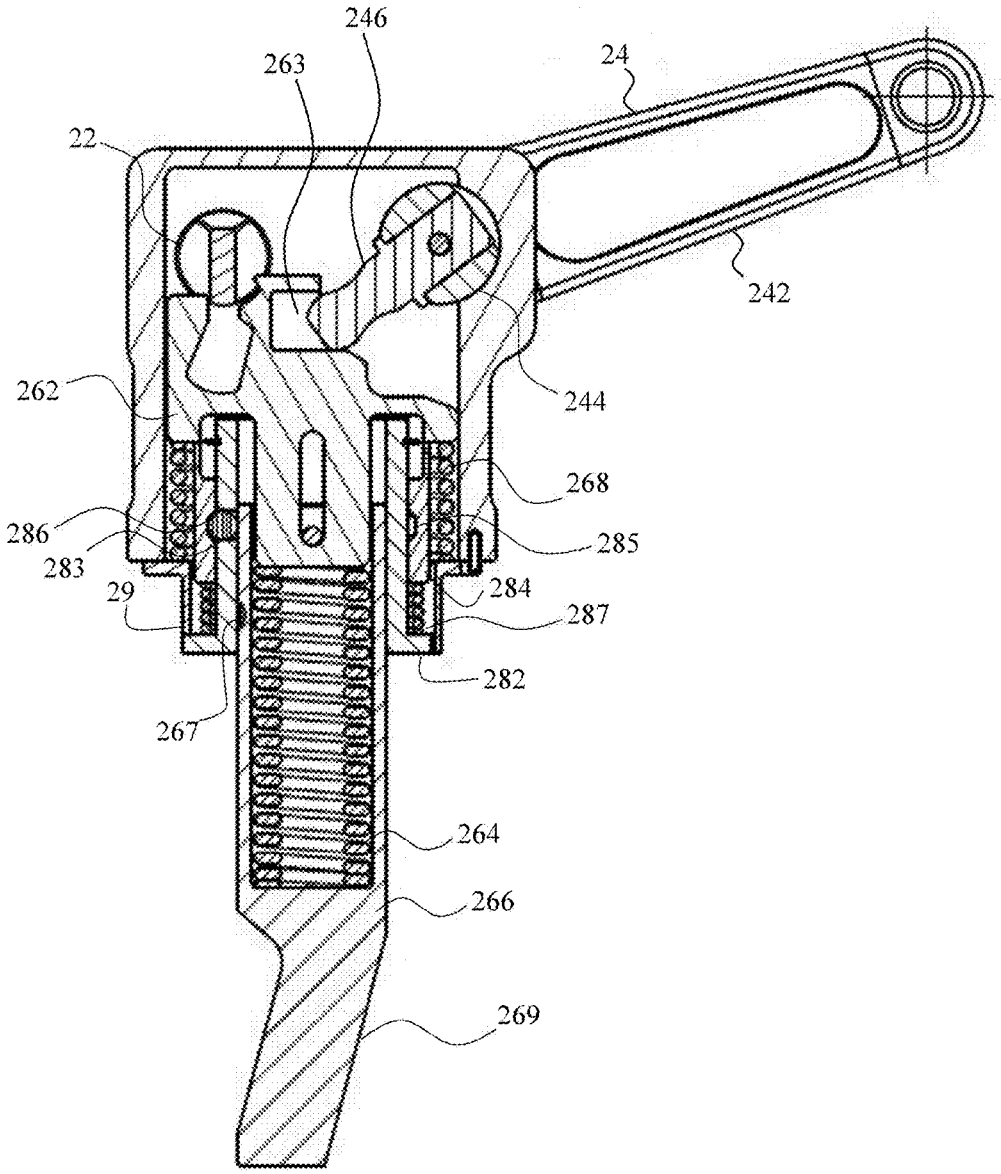
FIG. 5 is a side cross-sectional view of the firing mechanism in a lever fire mode, in accordance with an illustrative embodiment.
Figure 6:
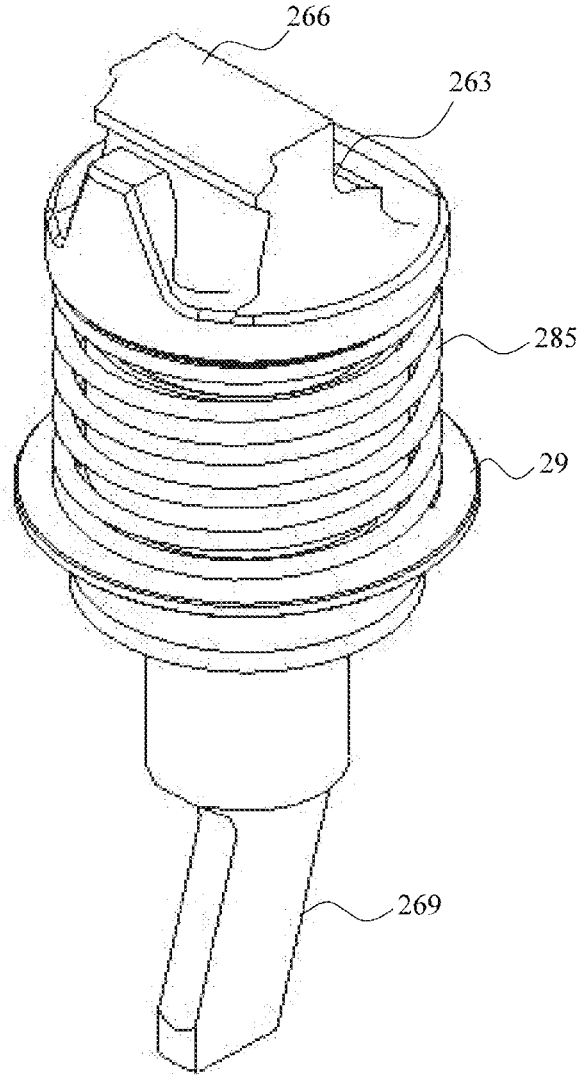
FIG. 6 is a perspective view of a sear assembly of the firing mechanism, in accordance with an illustrative embodiment.
Figure 7:
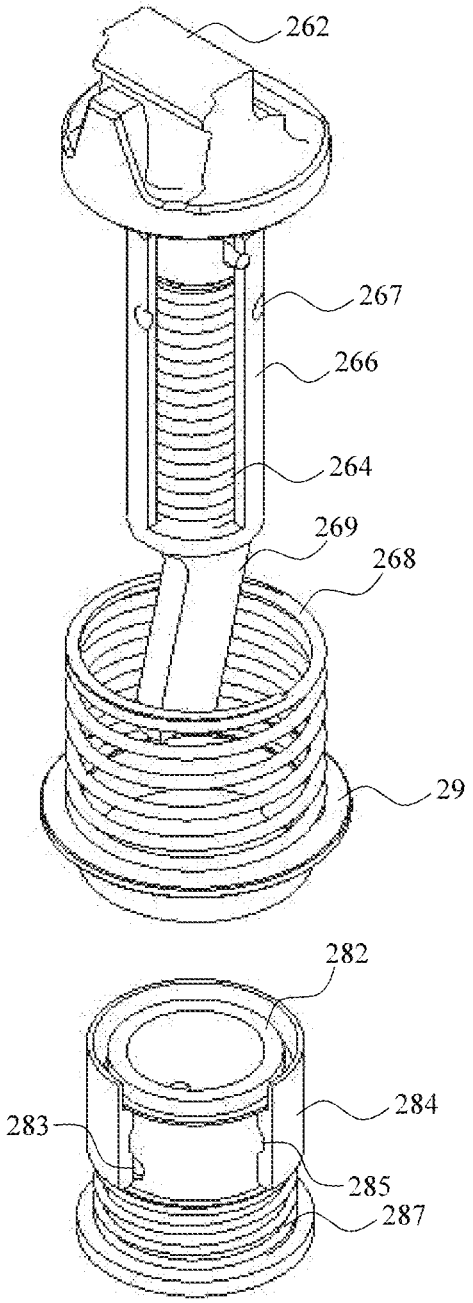
FIG. 7 is an exploded view of the sear assembly of the firing mechanism, in accordance with an illustrative embodiment.

FIG. 5 is a side cross-sectional view of the firing mechanism showing the firing mechanism placed in a lever fire mode, in accordance with an illustrative embodiment. FIG. 6 is a perspective view of a sear assembly of the firing mechanism, in accordance with an illustrative embodiment. FIG. 7 is an exploded view of the sear assembly of the firing mechanism, in accordance with an illustrative embodiment. When the selector 22 is placed in the position corresponding to lever fire mode, the sear assembly 26 is freed thereby allowing the lever assembly 24 to rotate through the firing sequence. A full firing sequence comprises the lever 24 rotating forward from a starting position to an end position and then back to the starting position to allow the firing mechanism 2 to reset.

The lever assembly 24 comprises a lever 242, a pivot shaft 244 and a pivot arm 246. The lever assembly 24 interacts with the sear assembly 26. The sear assembly 26 further comprises a plunger 262, a driver 266 and a die spring 264. The lever 242 has a thumb screw that connects the lever 242 to the pivot shaft 244 and allows an adjustment, through a set of grooved serrations to position the lever 242 in a convenient location for firing. The pivot shaft 244 houses a captured pivot arm 246 which is positioned into a shallow notch in a plunger 262. Rotation of the pivot arm 246 causes linear motion of the plunger 262.

When the plunger 262 is pushed down, it further compresses a preloaded die spring 264, which is housed in the driver 266. At the same time, it loads an outer compression spring 268 which will reseat the sear assembly 26 after firing. As the plunger 262 continues to depress, it contacts a sleeve 284 which is supported by another compression spring 287 that will reset the cage assembly 28 after firing.

The cage assembly 28 further comprises a cage 282, the sleeve 284 and a detent comprising three bearing balls 286. The driver 266 is held in place by the cage assembly 28 with three bearing balls 286 which are locked between grooves 267 on the driver 266, holes 283 in the cage 282 and holes 285 in the inside surface of the sleeve 284. As the plunger 262 pushes against the sleeve 284 and further compresses the die spring 264, the groove 267 in the sleeve 284 aligns with the bearing balls 286. The bearing balls 286 snap radially outward into said groove 267 and release the driver 266 which is accelerated downward by the die spring 264. This causes the front angled face of the driver 266 to thrust a firing pin 42 forward, perpendicular to the downward motion of the driver 266. A retainer 29 keeps the components of a driver assembly aligned with components of a cage assembly 28.

Releasing the lever 242 will reset the firing mechanism 2. The die spring 264 extends to its original preloaded length. The outer compression spring 264 pushes up on the plunger 262 which holds the driver 266. When the grooves 267 of the driver 266 align with the holes 283 in the cage 282, the three bearing balls 286 will snap from the groove 285 in the sleeve 284 into the grooves 267 of the driver 266 due to compression spring pushing against the sleeve 284. The sleeve 284 then snaps back into its original position.

Figure 8:
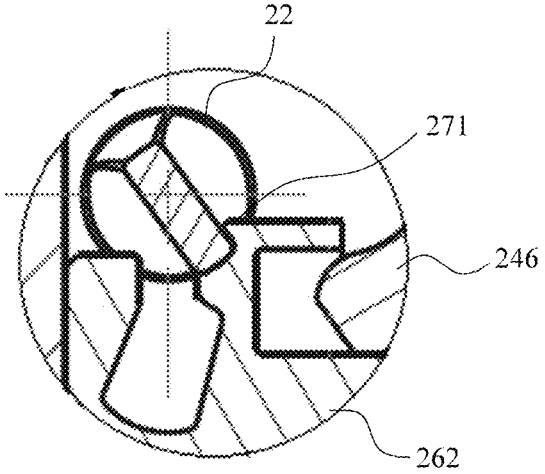
FIG. 8 is a sectional view of the selector showing the firing mechanism placed in a drop fire mode, in accordance with an illustrative embodiment.

FIG. 8 is a sectional view of the selector showing the firing mechanism placed in a drop fire mode, in accordance with an illustrative embodiment. The firing mechanism 2 is placed in drop fire mode by pulling the lever 242 in lever fire mode to initiate the firing sequence and extend the firing pin 42. The lever 242 is held in place while the selector 22 is rotated into the drop fire position. In this position, the die spring 264 holds the firing pin 42 forward and allows for maximum firing pin 42 protrusion.

When in the drop fire position, the selector 22 interfaces with a first feature 271, such as a depression or notch, in the plunger 262 sized and positioned such that the sear assembly 26 is held in the firing position and restricted from returning upwards and resetting the firing mechanism 2. In turn, the lever 242 is prevented from rotating back to its original position.

Figure 9:
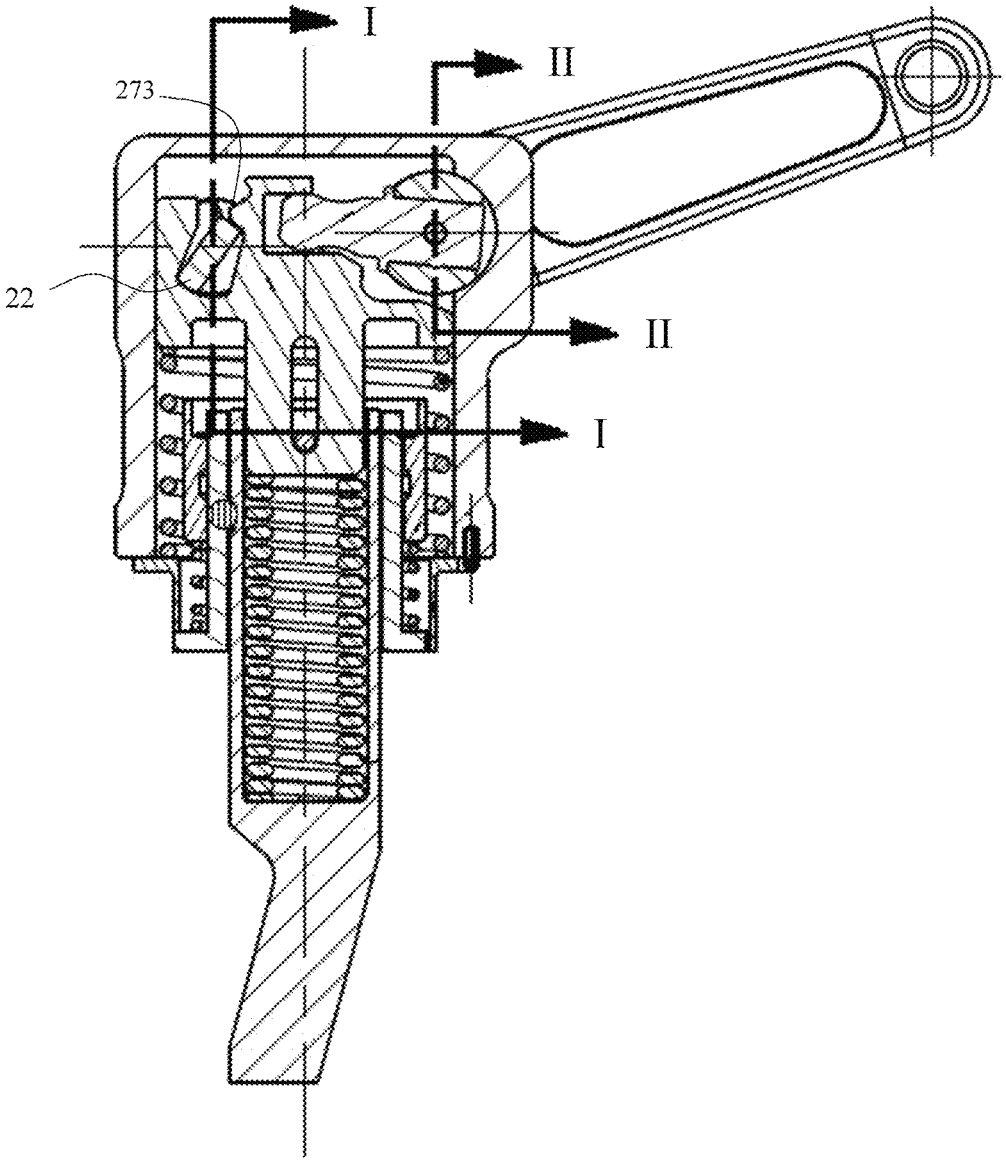
FIG. 9 is a side cross-sectional view of the firing mechanism in a safe fire mode, in accordance with an illustrative embodiment.

FIG. 9 is a side cross-sectional view of the firing mechanism placed in a safe mode, in accordance with an illustrative embodiment. The firing mechanism 2 is placed in safe mode from lever fire mode by rotating the selector 22 to the safe position. The firing mechanism 2 is placed in safe mode from drop fire mode by first rotating the selector 22 to the lever fire position. This allows the firing mechanism 2 to reset. Once the firing mechanism 2 has reset, the selector 22 is then rotated to the safe mode position.

When in the safe position, the selector 22 interfaces with a second feature 273, such as a depression or notch, in the plunger 262 sized and positioned such that the driver assembly is restricted from downward movement. In turn, the lever 242 is restricted from rotating through the firing sequence.

Figure 10:
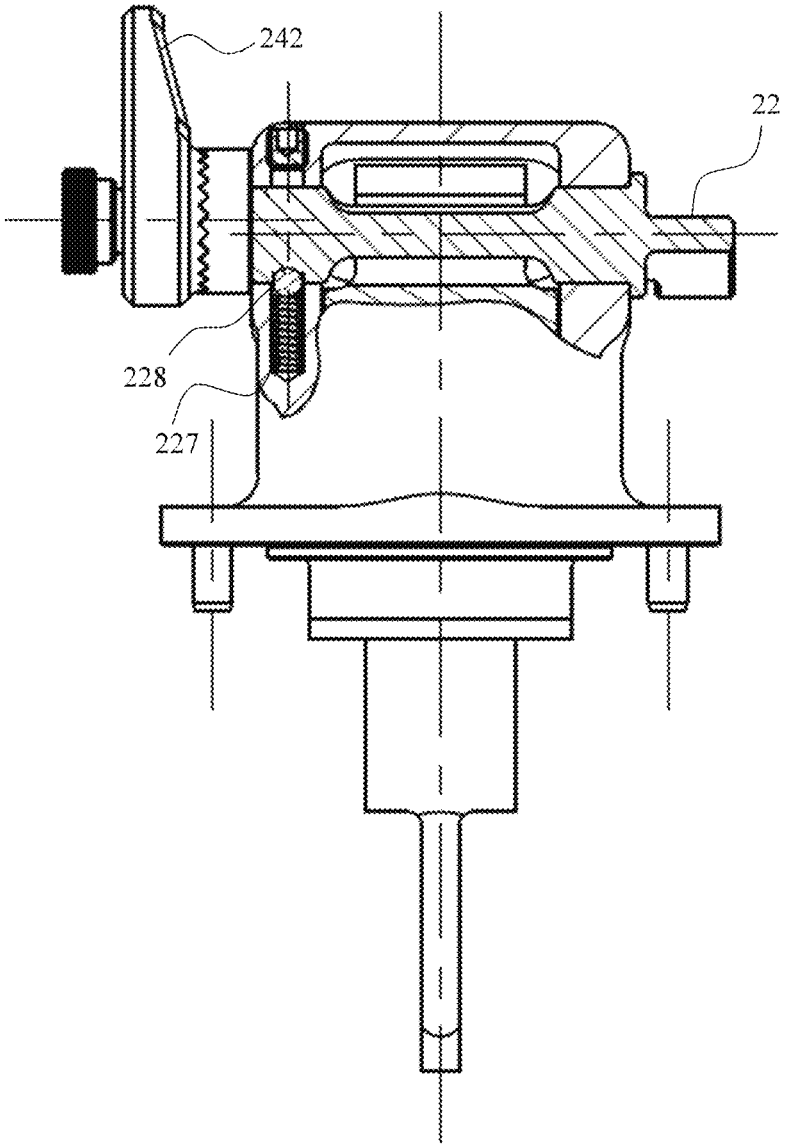
FIG. 10 is a front view for the firing mechanism with a cutaway, in accordance with an illustrative embodiment.
Figure 11:
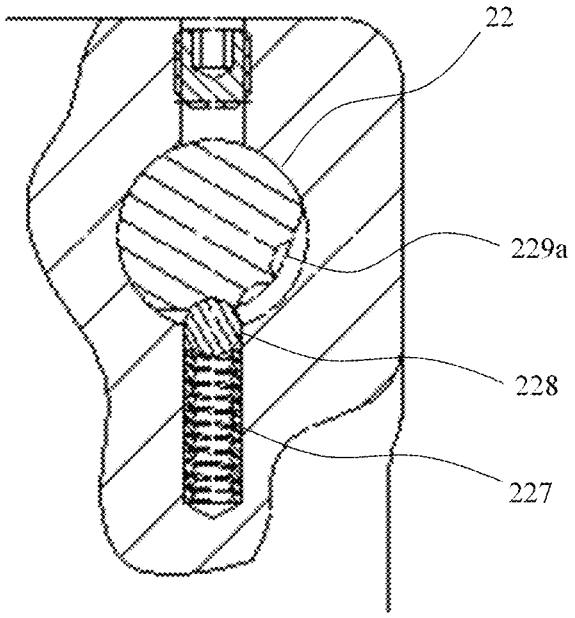
FIG. 11 is a close-up view of a section of the selector, in accordance with an illustrative embodiment.

FIG. 10 is a front view for the firing mechanism with a partial cutaway along the cutting plane I-I shown in FIG. 7, in accordance with an illustrative embodiment. The cutaway shows a section view of the selector 22. The selector 22 is held in place by a detente comprising a compression spring 227 and ball 228. FIG. 11 is a close-up view of a section of the selector, in accordance with an illustrative embodiment. The selector 22 comprises three detent grooves 229 which each correspond to an operating mode. The ball 228 is pressed against the groove 229 by the compression spring 227 to keep the selector 22 switch in a desired position.

Figure 12:
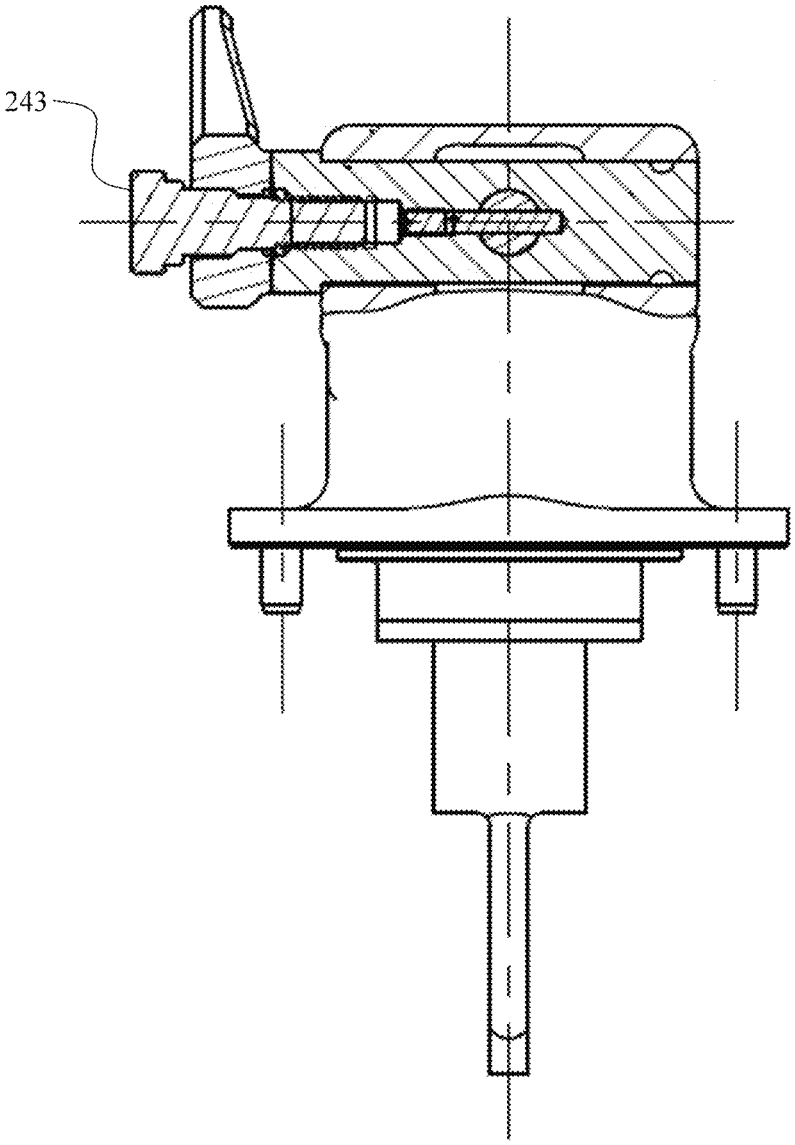
FIG. 12 is a front view of the firing mechanism with a cutaway, in accordance with an illustrative embodiment.

FIG. 12 is a view of the firing mechanism with a partial cutaway along the cutting plane II-II shown in FIG. 7, in accordance with an illustrative embodiment. The cutaway shows a section view of the lever assembly 24. The lever 242 comprises a thumb screw 243 that connects the lever 242 to the pivot shaft 244 and allows an adjustment, through a set of grooved serrations, to position the lever 242 in a convenient location for firing.

While the invention has been described with reference to certain embodiments, numerous changes, alterations and modifications to the described embodiments are possible without departing from the spirit and scope of the invention as defined in the appended claims, and equivalents thereof.

What is claimed is:

1. A firing mechanism assembly for a mortar system capable of operating in a drop fire mode, a lever fire mode and a safe mode, the firing mechanism comprising:

a lever assembly further comprising a lever for receiving a rotational input from a user;

a sear assembly engaged with the lever assembly for transferring a rotational translation of the lever assembly to a linear translation of a driver thereby causing a firing pin to protrude into a cannon, the sear assembly further comprising a plunger for engaging with the lever assembly and compressing a spring in response to a forward rotation of the lever assembly, the driver in communication with the spring and translated downward by the spring after a threshold compression of the spring thereby causing the firing pin to protrude into the cannon, and a cage assembly for holding the driver in place until the threshold compression of the spring;

a selector for placing the firing mechanism assembly in either the drop fire mode, the lever fire mode or the safe mode by selectively restricting movement of the lever wherein when the selector is placed in the drop fire mode, the selector is rotated to a position where the selector engages with a first feature of the plunger such that the plunger is restricted from resetting.

2. The firing mechanism assembly of claim 1 wherein when the selector is placed in the lever fire mode, the lever is able to rotate through a full firing sequence.

3. The firing mechanism assembly of claim 2 wherein when the selector is placed in the lever fire mode, the selector is rotated such that it does not engage with the plunger.

4. The firing mechanism of claim 1 wherein when the selector is placed in the drop fire mode, the driver is held in contact with the firing pin by the spring.

5. The firing mechanism assembly of claim 1 wherein when the selector is placed in the safe mode, the lever assembly is restricted from rotating from a starting position.

6. The firing mechanism of claim 5 wherein when the selector is placed in the safe mode, the selector is rotated to a position in which the selector engages with a second feature of the plunger such that the plunger is restricted from downward translation.

7. The firing mechanism of claim 1 wherein the selector comprises three detent grooves for engaging with a ball detent and wherein the ball detent holds the selector in one of three positions.

8. The firing mechanism of claim 1 wherein the cage assembly further comprises a cage having a hole defined by the cage and dimensioned for holding a bearing ball;

a sleeve concentric with the cage and the driver and having a groove defined by an inner surface of the sleeve;

the bearing ball restrained in the cage and between the inner surface of the sleeve and the driver thereby holding the driver in place until the sleeve is translated downward by the downward translation of the plunger causing the bearing ball to engage the groove of the sleeve and disengage the driver thereby allowing the driver to translate downward under force by the spring and causing the firing pin to protrude into the cannon.

9. The firing mechanism of claim 1 wherein the firing mechanism comprises a housing and wherein the housing further comprises a base defining four mounting holes sized and dimensioned to correspond with mounting holes on a weapon system.

10. The firing mechanism of claim 9 wherein the weapon system is a 120 mm mortar system.

11. The firing mechanism of claim 10 wherein the firing mechanism is mounted on an external surface of the base cap of the mortar system with the driver protruding into an opening of the base cap.

12. A firing mechanism assembly for a mortar system capable of operating in a drop fire mode, a lever fire mode and a safe mode, the firing mechanism comprising:

a lever assembly further comprising a lever for receiving a rotational input from a user, a pivot shaft connected to the lever, a pivot arm having an engagement portion at a distal end of the pivot arm;

a sear assembly engaged with the lever assembly for transferring rotational motion of the lever assembly to a linear motion of a driver thereby causing a firing pin to protrude into a cannon, the sear assembly further comprising a plunger having a first notch for engaging with the engagement portion of the pivot arm thereby translating downward in response to a rotation of the pivot arm, a die spring having a preloaded compression and in communication with the plunger such that downward translation of the plunger further compresses the die spring, the driver in communication with the die spring and restrained by a cage assembly until the plunger is translated a threshold distance thereby releasing the driver to be translated by the die spring, the driver further comprises an angled head for engaging with and causing the firing pin to protrude into the cannon, and a cage assembly for restraining the driver in place and further comprising a cage concentric with and surrounding a portion of the driver having a hole defined by the cage and dimensioned for holding a bearing ball;

a sleeve concentric with and surrounding a portion of the cage and having a groove defined by an inner surface of the sleeve, and a detent for selectively restraining the driver and further comprising a bearing ball restrained in the cage and between the inner surface of the sleeve and the driver thereby holding the driver in place until the sleeve is translated downward by the downward translation of the plunger causing the bearing ball to engage the groove of the sleeve and disengage the driver;

a selector for placing the firing mechanism assembly in either the drop fire mode, the lever fire mode or the safe mode by selectively restricting movement of the lever.

13. The firing mechanism assembly of claim 12 wherein when the selector is placed in the lever fire mode, the selector is rotated such that the lever does not engage with the plunger thereby allowing the lever to rotate through a full firing sequence.

14. The firing mechanism assembly of claim 12 wherein when the selector is placed in drop fire mode, the selector is rotated to a position wherein the selector engages with a first feature of the plunger such that the plunger is restricted from resetting after firing.

15. The firing mechanism of claim 14 wherein when the selector is placed in the drop fire mode, the driver is held in contact with the firing pin by the die spring.

16. The firing mechanism assembly of claim 12 wherein when the selector is placed in the safe mode, the selector is rotated to a position such that the selector engages a second feature in the plunger such that the plunger is restricted from downward translation.

* * * * *